US006127083A

United States Patent [19]

Nomura et al.

[11] Patent Number: 6,127,083

[45] **Date of Patent: *Oct. 3, 2000**

[54] IMAGE FORMING METHOD USING SPHERICAL TONER PARTICLE

[75] Inventors: Minoru Nomura, Saitama; Takashi Ito, Tokyo; Hitoshi Takayanagi; Kazuo Itoya, both of Saitama, all of Japan

[73] Assignee: Dainippon Ink and Chemicals, Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/239,822

[22] Filed: Jan. 29, 1999

[30] Foreign Application Priority Data

Jan. 30, 1998 [JP] Japan ..... 10-019016

[51] Int. Cl.[7] ..... G03G 13/08

[52] U.S. Cl. ..... 430/120; 430/102; 430/111

[58] Field of Search ..... 430/101, 102, 430/120

[56] References Cited

U.S. PATENT DOCUMENTS 5,328,792 7/1994 Shigemori et al. ..... 430/120
5,589,313 12/1996 Takezawa et al. ..... 430/120
5,620,823 4/1997 Kambayashi et al. ..... 430/102
5,688,622 11/1997 Ito et al. ..... 430/102

*Primary Examiner*—Roland Martin
*Attorney, Agent, or Firm*—Armstrong, Westerman, Hattori, McLeland & Naughton

[57] ABSTRACT

A non-magnetic one-component development process is provided which comprises supplying a developer onto a photoreceptor using a non-magnetic one-component developing machine comprising at least a developer-supporting roll and a layer-forming blade so that an electrostatic latent image on said photoreceptor is developed, characterized in that as said developer there is used a spherically particulate toner having a volume-average particle diameter of from 1 to 6 $\mu$m and the amount of said toner to be attached to said developer-supporting roll is from 0.1 mg/cm$^2$ to 0.45 mg/cm$^2$. In accordance with the process of the present invention, the image quality can be drastically improved while drastically reducing the consumed amount of the toner. In particular, by predetermining the colorant content in the spherically particulate toner to be used in the development process of the present invention to not less than 8% by weight, if the colorant is carbon black, or not less than 3% by weight, if the colorant is an organic pigment, the image quality can be further improved. Further, by optimizing the circularity, particle size distribution, added amount of inorganic material fine particles and other conditions of the spherically particulate toner, the image quality can be even further improved.

8 Claims, No Drawings

IMAGE FORMING METHOD USING SPHERICAL TONER PARTICLE

FIELD OF THE INVENTION

The present invention relates to a novel non-magnetic one-component developing method which can form high quality image and drastically reduce the amount of toner to be consumed per page in an electrophotographic printer or copying machine.

BACKGROUND OF THE INVENTION

Images outputted from electrophotographic copying machines or printers have far poorer quality than lithographic print or silver salt system photograph. Thus, various improvements have been made both in image forming apparatus and powder toner used therefor.

For the part of toner, it has recently been necessary more and more to reduce the particle diameter of particulate toner in order to improve image quality such as resolution. Various technical developments have been made.

However, most of powder toners for development of electrostatic image commercially available at present have a volume-average particle diameter of from about 8 to 13 μm. Powder toners having the smallest particle diameter have a volume-average particle diameter of about 7 μm (as measured by means of Coulter Multisizer). Thus, the smallest allowable particle diameter of particulate toners extremely useful for the enhancement of image resolution is about 7 μm at present. No particulate toners having smaller particle diameters are commercially produced. Little or no developing machines using such a small particle size toner have been developed.

It has thus been keenly desired to provide a toner having an even smaller particle diameter and an excellent triboelectricity and develop a development process using such a toner.

A powder toner is prepared by a dry process such as pulverization method or a wet process such as polymerization process and so-called phase inversion emulsification method as described in JP-A-5-66600 (The term "JP-A" as used herein means an "unexamined published Japanese patent application"). It is said that the smallest allowable particle diameter of toners produced by a pulverization method using the present crushing machine on an industrial basis is about 7 μm. Of course, small particle diameter toners having a particle diameter of about 5 μm can be produced. However, these toners cannot hardly be considered practical because they add to cost and exhibit deteriorated triboelectricity or powder fluidity caused by the reduction of the particle diameter thereof.

The wet process such as polymerization process and emulsification process is said to be essentially free from difficulty caused by the reduction of the toner particle diameter. However, the prior art wet process toner is mainly intended in the stage of development or production to replace the foregoing pulverization process toner having an ordinary volume-average particle diameter range (about 7 to 13 μm). Small particle diameter toners having a volume-average particle diameter of not more than about 6 μm have been so far known only in fragments. No practical formulations have been known.

On the other hand, for the part of image forming apparatus, studies have been made to cope with the reduction of the particle diameter of toners for the purpose of improving image quality. As mentioned above, however, toners having a sufficiently small particle diameter cannot be produced invariably. Therefore, for the part of image forming apparatus, a complete image forming method corresponding to such a small particle diameter toner cannot be developed. Accordingly, an image forming method which allows the formation of high resolution image and is adapted for a small particle diameter toner having a volume-average particle diameter of not more than about 6 μm has never been sufficiently established.

SUMMARY OF THE INVENTION

The inventors made extensive studies of improvement of image quality in non-magnetic one-component development process. As a result, it was found that the use of a spherically particulate toner having a volume-average particle diameter of from 1 to 6 μm as a developer and the predetermination of the amount of toner to be attached to a developer-supporting roll, which has heretofore been from about 0.5 to 0.7 mg/cm$^2$, to a range of from 0.1 to 0.45 mg/cm$^2$ make it possible to realize drastic improvement of image quality and drastic reduction of the consumed amount of toner.

The present invention provides the following inventions:

1. A non-magnetic one-component development process which comprises supplying a developer onto a photoreceptor using a non-magnetic one-component developing machine comprising at least a developer-supporting roll and a layer-forming blade so that an electrostatic latent image on said photoreceptor is developed, wherein said developer is a spherically particulate toner having a volume-average particle diameter of from 1 to 6 μm and the amount of said toner to be attached to said developer-supporting roll is from 0.1 mg/cm$^2$ to 0.45 mg/cm$^2$.

2. The non-magnetic one-component development process according to Clause 1, wherein said developer is a spherically particulate toner comprising a styrene (meth) acrylate resin as a binder resin and carbon black as a colorant, the content of said carbon black being not less than 8% by weight.

3. The non-magnetic one-component development process according to Clause 1, wherein said developer is a spherically particulate toner comprising a polyester resin as a binder resin and an organic pigment as a colorant, the content of said organic pigment being not less than 3% by weight.

4. The non-magnetic one-component development process according to any one of Clauses 1 to 3, wherein said developer is a spherically particulate toner having an average circularity (average of circularity defined by (perimeter of circle having the same area as the projected area of particle)/(perimeter of the projected image of particle)) of not less than 0.97 comprising a colorant encapsulated in a binder resin.

5. The non-magnetic one-component development process according to Clause 4, wherein said spherically particulate toner as developer comprises inorganic oxide fine particles externally added thereto in an amount represented by the following relationship:

$$3.5714X^{-0.9942} \leqq Y \leqq 31.399X^{-0.9477}$$

wherein X represents a volume-average particle diameter (μm) of toner particles; and Y represents an added amount (wt-%) of inorganic oxide fine particles based on the weight of toner particles.

6. The non-magnetic one-component development process according to Clause 5, wherein said spherically particulate toner as developer has a particle size distribution such that the ratio of 50%-volume particle diameter/50%-number particle diameter is not more than 1.25 and the square root of the ratio of 84%-volume particle diameter/16%-volume particle diameter is not more than 1.25.

7. The non-magnetic one-component development process according to Clause 4, wherein said particulate toner is obtained by a process which comprises mixing an organic solvent solution comprising a colorant and a water-insoluble binder resin as essential components and an aqueous medium, emulsifying the mixture to form spherical colored particles, and then withdrawing the said particles dispersed in the liquid medium in the form of dried powder.

8. The non-magnetic one-component development process according to Clause 4, wherein said particulate toner is obtained by a process which comprises allowing polymerizable monomers having a colorant dispersed therein to undergo polymerization in a liquid medium to form spherical colored particles, and then withdrawing the said particles dispersed in the liquid medium in the form of dried powder.

DETAILED DESCRIPTION OF THE INVENTION

An object of the present invention is to provide a process for the formation of a high quality image using a toner having a particle diameter as small as 1 to 6 μm excellent in triboelectricity for use in the developmment of electrostatic images in an electrophotographic copying machine or printer. In particularly, the present invention provides a non-magnetic one-component developmment process. In accordance with the present invention, improvement of the quality of images outputted from copying machines or printers can be realized.

The inventors made extensive studies of improvement of image quality in non-magnetic one-component developmment. As a result, it was found that the predetermination of the amount of toner to be attached to the developer-supporting roll, which has heretofore been from about 0.5 to 0.7 mg/cm$^2$, to a range of from 0.1 to 0.45 mg/cm$^2$ makes it possible to realize drastic improvement of image quality. This can be easily accomplished by the use of a spherically particulate toner having a volume-average particle diameter of from 1 to 6 μm, preferably from 2 to 6 μm.

The inventors also found that the use of a spherically particulate toner, as a black developer, comprising carbon black incorporated therein as a colorant in an amount of not less than 8% by weight makes it possible to realize image density in addition to image resolution and tone reproduction at a high level. It was further found that the use of a styrene acrylic resin as a binder resin makes it possible to exert far better effect.

The inventors further found that the use of a spherically particulate toner, as a cyan, magenta or yellow color developer, comprising an organic pigment incorporated therein as a colorant in an amount of not less than 3% by weight makes it possible to realize a high image quality. It was further found that the use of a polyester resin as a binder resin makes it possible to exert far better effect.

The inventors further found that the use of a toner having an average circularity (average of circularity defined by (perimeter of circle having the same area as the projected area of particle)/(perimeter of the projected image of particle)) of not less than 0.97 and comprising a colorant encapsulated in a binder resin makes it possible to satisfy more easily the foregoing requirements for the amount of toner to be attached to the developer-supporting roll and further improve image quality.

The inventors further found that the use of a spherically particulate toner comprising inorganic oxide fine particles externally added thereto in an amount represented by the following relationship makes it possible to further improve image quality:

$$3.5714X^{-0.9942} \leq Y \leq 31.399X^{-0.9477}$$

wherein X represents a volume-average particle diameter (μm) of toner particles; and Y represents an added amount (wt-%) of inorganic oxide fine particles based on the weight of toner particles.

This is because the toner satisfying the foregoing requirements exhibits remarkable improvements in basic characteristics of toner such as triboelectricity and fluidity.

The inventors further found that the use of a spherically particulate toner having a particle size distribution such that the ratio of 50%-volume particle diameter/50%-number particle diameter is not more than 1.25 and the square root of the ratio of 84%-volume particle diameter/16%-volume particle diameter is not more than 1.25 makes it possible to further improve image quality.

The inventors further found that the use of a spherically particulate toner obtained by a process which comprises mixing an organic solvent solution comprising a colorant and a water-insoluble binder resin as essential components and an aqueous medium, emulsifying the mixture to form spherical colored particles, and then withdrawing the said particles dispersed in the liquid medium in the form of dried powder or a process which comprises allowing polymerizable monomers having a colorant dispersed therein to undergo polymerization in a liquid medium to form spherical colored particles, and then withdrawing the said particles dispersed in the liquid medium in the form of dried powder makes it possible to easily obtain a particulate toner adapted for the foregoing non-magnetic one-component developmment process of the present invention.

The background and detailed description of the present invention will be further described hereinafter.

The inventors made extensive studies paying their attention to the fact that the most basic conditions of image forming method using an image forming apparatus must be properly predetermined, not to mention the reduction of the particle diameter of toner, to improve image quality such as resolution, tone reproduction, fog resistance and image density. As a result, it was found that when the amount of toner to be attached to the developer-supporting roll in a non-magnetic one-component developing machine which is put into practical use at present is reduced to a range of from 0.1 to 0.45 mg/cm$^2$, preferably from 0.2 to 0.4 mg/cm$^2$, from the current range of from about 0.5 to 0.7 mg/cm$^2$ by using as a developer a spherically particulate toner having a volume-average particle diameter of from 1 to 6 μm, preferably from 2 to 6 μm, image quality can be remarkably improved.

If the amount of toner to be attached to the developer-supporting roll is too great, excess toner is transferred to the printing material through the photoreceptor, resulting in the deterioration of resolution or tone reproduction of printed image. On the contrary, if the amount of toner to be attached to the developer-supporting roll is too small, the resulting printed image has an insufficient density and thus can be hardly put into practical use.

In order to drastically improve image quality, it is effective to control the thickness of the toner layer on the printing material to a proper range. To this end, it is indispensable to predetermine the amount of toner to be attached to the developer-supporting roll to a proper range. The inventors found a powder toner having characteristics most suitable for the improvement of image quality. The inventors further succeeded in the developmment of a process which can invariably produce such a toner. The inventors further found a novel image forming process involving the use of the foregoing optimum attached amount of toner which can remarkably improve image quality with such a toner.

In order to realize the amount of toner to be attached to the developer-supporting roll according to the present invention, it is preferred that the toner to be used have a reduced particle diameter and be in the form of sphere to exhibit a required powder fluidity.

The inventors further found that the particle diameter of the toner predetermined such that the amount of toner to be attached to the developer-supporting roll is adjusted to the foregoing optimum range is preferably from 1 to 6 μm, more preferably from 2 to 6 μm, even more preferably from 3 to 6 μm, in terms of a volume-average particle diameter.

The thickness of the toner image layer printed with the prior art powder toner is very greater than that of the high quality ink image layer printed with a lithographic printing ink or the like. In order to improve the image quality, it is important to reduce the thickness of the toner image layer thus printed from the current value. When the particle diameter of the toner is reduced and the amount of the toner to be attached to the developer-supporting roll is reduced, the amount of the toner taking part in image formation is reduced, occasionally causing a drop of image density. Thus, it is necessary to secure a required image density by increasing the content of colorant in the toner.

Accordingly, in order to obtain a sufficient print image density with a particulate toner having a particle diameter as small as 1 to 6 μm, for which the present invention is intended, it is indispensable to predetermine the pigment concentration in the toner to not less than a certain value. Thus, it is occasionally necessary to predetermine the colorant concentration higher than commercially available toners having an ordinary size (about 7 μm to 13 μm).

The powder toner having a particle diameter of from 1 μm to 6 μm of the present invention, if it is a black toner comprising carbon black incorporated therein as a colorant, needs to comprise carbon black incorporated therein in an amount of not less than 8% by weight, preferably not less than 9% by weight based on the sum of the weight of the binder resin and colorant used. Further, the color toner comprising an organic pigment incorporated therein as a colorant needs to comprise an organic pigment incorporated therein in an amount of not less than 3% by weight, preferably not less than 4% by weight based on the sum of the weight of the binder resin and colorant used.

Referring to the black toner, the use of a styrene-acryl resin as a binder resin makes it easy to control the fixability of the toner to advantage. Referring to the color toner, the use of a polyester resin as a binder resin makes it possible to obtain an excellent color developability or gloss to advantage.

Moreover, the use of a toner having an average circularity (average of circularity defined by (perimeter of circle having the same area as the projected area of particle)/(perimeter of the projected image of particle)) of not less than 0.97, preferably not less than 0.98 makes it easy to satisfy the foregoing requirements for the amount of toner to be attached to the developer-supporting roll. This is because the use of a spherically particulate toner having a high circularity and a small particle diameter makes it easy to form uniformly a thin toner layer on the developer-supporting roll.

If the particle diameter of powder toner obtained by pulverization process is reduced, the crushing energy cost shows a rapid rise when it reaches about 6 μm. Further, the resulting toner particles are amorphous and thus exhibit a deteriorated triboelectricity or powder fluidity. This is a great problem arising when a particulate toner having a particle diameter of not more than about 6 μm is put into practical use.

However, the deterioration of the powder fluidity of a toner due to reduction of particle diameter can be remarkably prevented by making the toner particles spherical. The particulate toner having a particle diameter of from 1 μm to 6 μm, for which the present invention is intended, needs to have an average circularity of not less than 0.97. The average circularity can be determined by taking SEM (scanning type electron microscope) photograph of toner particles, measuring the size of the toner particles on the photograph, and then calculating the average circularity from the measurements. However, it can be easily measured by means of a Type FPIP-1000 flow type particle image analyzer produced by Toa Iyo Denshi K. K.

On the other hand, the inventors conjecture that the deterioration of triboelectricity due to the reduction of particle diameter is mainly attributed to the exposure of a part of the colorant or other additives (normally wax or charge control agent) at the surface of the toner particles. In other words, even if the content (% by weight) of colorant or the like is the same, the reduction of particle diameter causes an increase in the surface area of the toner particles and hence an increase in the proportion of colorant exposed at the surface of the toner particles, resulting in a drastic change in the composition of the surface of the toner particles and hence a drastic change in the triboelectricity of the toner particles. Thus, the triboelectricity of the smaller toner particles can be difficultly controlled.

In order to keep the triboelectricity of the toner particles good even if the particle diameter of the toner particles is reduced, it is effective to prevent the colorant or other additives from being exposed at the surface of the toner particles, that is, arrange the toner structure such that the colorant or other additives are encapsulated in the toner particles.

Whether or not the colorant, charge control agent, wax or the like are exposed at the surface of the toner particles can be easily judged by observing a section of the toner particle by TEM (transmission type electronmicroscope). In some detail, the toner particle of the present invention is embedded in a resin. The embedded toner particle is then cut by a microtome. The specimen thus prepared may be dyed with ruthenium oxide or the like if necessary. By observing the section of the particle by TEM, it can be clearly seen whether or not the colorant or other additives are encapsulated in the toner particles.

Theoretically speaking, the spherically particulate toner having a particle diameter of from 1 to 6 μm comprising a colorant encapsulated in toner particles can be obtained, e.g., by subjecting amorphous particles prepared by pulverization method to surface treatment with a resin so that they are rendered spherical. In practice, however, a wet process such as polymerization process and emulsification process can be actually employed to advantage from the standpoint of ease of production and cost. In particular, emulsification process is suitable for the preparation of the particulate toner of the present invention because even if the kind of binder resin to be used is varied, spherical colored particles having a good particle size distribution can be formed and the pigment concentration can be easily raised.

The use of such a process makes it easier to give a sharp toner particle diameter distribution as described below. The resulting toner can exert a higher effect of improving the image quality.

The particle size distribution of the toner particles, too, has an effect on the triboelectricity of the toner. In particular, the small particle diameter toner to be used in the present invention must have a sharper particle size distribution than commercially available toners having a particle diameter of from about 7 μm to 13 μm. In other words, the small particle diameter toner having a volume-average particle diameter of from 1 μm to 6 μm, for which the present invention is intended, must satisfy the requirements that it has a particle size distribution such that the ratio of 50%-volume particle diameter/50%-number particle diameter is not more than 1.25, preferably not more than 1.20 and the square root of the ratio of 84%-volume particle diameter/16%-volume particle diameter is not more than 1.25, preferably not more than 1.20, to exhibit a good triboelectricity and hence provide a high quality printed image free of fog.

Further, it can be thought that the use of a spherically particulate toner having a small particle diameter and a sharp particle size distribution adds to the uniformity in arrangement of toner particles on the developmment roll, making it possible to cover the developmment roll with less toner.

The use of such a spherically particulate toner having a small particle diameter and a narrow particle size distribution is remarkably advantageous in that it leads not only to the improvement of image quality but also to the drastic reduction of the amount of the toner to be consumed per sheet of printing. The reduction of the amount of the toner to be consumed per sheet of printing gives an advantage that the printing/copying cost can be reduced and the capacity of the toner box in the machine can be reduced.

Further, also by properly selecting the kind or amount of the inorganic oxide fine particles to be attached to the surface of the toner particles, the triboelectricity and powder fluidity of the small particle diameter toner can be improved. Examples of the inorganic oxide fine particles employable in the present invention include silica (silicon oxide), titanium oxide, aluminum oxide, zinc oxide, tin oxide, antimony oxide, and magnesium oxide. These particulate inorganic oxides may be used singly or in combination.

Particularly preferred among these inorganic oxide fine particles is hydrophobicized silica having a primary particle diameter of from about 5 nm to 50 nm. Silica is preferably used in combination with other inorganic oxide fine particles as necessary. Many kinds of hydrophobic silica for toner have been commercially available. It is practically advantageous that any desirable silica is selected from these commercial products.

The amount of the inorganic oxide fine particles to be added depends on the purpose of the powder toner. In practice, however, the smaller the particle diameter of the toner particles is, the more should be the added amount. The particulate toner having a particle diameter of from 1 μm to 6 μm of the present invention preferably comprises such a particulate inorganic oxide incorporated therein in an amount represented by the following relationship based on the toner:

$$3.5714X^{-0.9942} \leqq Y \leqq 31.399X^{-0.9477}$$

wherein X represents a volume-average particle diameter (μm) of toner particles; and Y represents an added amount (wt-%) of particulate inorganic oxide based on the weight of toner particles.

The addition of the inorganic oxide fine particles can be accomplished by any known commonly used method using a Henschel mixer, Hybridizer or the like.

In other words, the use of a toner satisfying the foregoing requirements makes it possible to remarkably improve the triboelectricity or fluidity of the toner.

As mentioned above, the non-magnetic one-component developmment process of the present invention involves the predetermination of the amount of toner to be attached to the developer-supporting roll to a range of from 0.1 mg/cm$^2$ to 0.45 mg/cm$^2$ that makes it possible to accomplish remarkable improvement of image quality. In order to keep better image quality while predetermining the amount of the toner to be attached to the developer-supporting roll to the above defined range, it is necessary that the composition and preparation process of the toner, too, be predetermined to better conditions as previously mentioned.

Preferred composition and preparation process of the toner to be used in the image formation process of the present invention will be further described hereinafter.

The colorant to be incorporated in the powder toner of the present invention is not specifically limited. In practice, however, any colorant which has heretofore been used for electrophotographic toner may be used. Preferred among these colorants are pigments. Examples of these pigments will be given below.

Examples of black pigments include carbon black, cyanine black, aniline black, ferrite, and magnetite. Alternatively, pigments prepared by processing the following organic chromatic pigments so that they are rendered black may be used. However, carbon black is preferred.

Examples of yellow pigments include chrome yellow, zinc yellow, cadmium yellow, Hydrated Yellow, yellow ochre, Titanium Yellow, naphthol yellow S, Hansa Yellow 10G, Hansa Yellow 5G, Hansa Yellow G, Hansa Yellow GR, Hansa Yellow A, Hansa Yellow RN, Hansa Yellow R, pigment yellow L, benzidine yellow, benzidine yellow G, benzidine yellow GR, permanent yellow NCG, vulcan fast yellow 5G, vulcan fast yellow R, quinoline yellow lake, anthragen yellow 6GL, permanent yellow FGL, permanent yellow H10G, permanent yellow HR, anthrapyrimidine yellow, other isoindolinone yellow, chromophthal yellow, novoperm yellow H2G, condensed azo yellow, nickel azo yellow, and copper azomethylene yellow.

Examples of red pigments include red chrome yellow, molybdenum orange, permanent orange GTR, pyrazolone orange, vulcan orange, indathrene brilliant orange RK, indathrene brilliant orange GK, benzidine orange G, permanent red 4R, permanent red BL, permanent orange F5RK, lithol red, pyrazolone red, watching red, lake red C, lake red D, brilliant carmine 6B, brilliant carmine 3B, rhodamine lake B, alizarine lake, permanent carmine FBB, perinone orange, isoindolinone orange, anthanthrone orange, pyranthrone orange, quinacridone red, quinacridone magenta, quinacridone scarlet, and perylene red.

Examples of blue pigments include cobalt blue, cerulean blue, alkali blue lake, peacock blue lake, fanatone blue 6G, victoria blue lake, metal-free phthalocyanine blue, copper phthalocyanine blue, fast sky blue, indathrene blue RS, indathrene blue BC, and indigo.

An emulsification process for the preparation of a particulate toner to be used in the present invention will be described hereinafter. In some detail, an organic solvent solution comprising a colorant and a water-insoluble binder resin as essential components and an aqueous medium are mixed and emulsified to form spherical colored resin particles. The organic solvent is then removed from the liquid medium in which the particles are dispersed. The particles dispersed in the aqueous medium are then withdrawn in the form of dried powder. If necessary, the particles are then classified to adjust the particle size distribution thereof. Thus, the desired particulate toner is obtained.

In order to form spherical colored particles by emulsification, a method free from organic solvent may be used as described in U.S. Pat. No. 5,843,614. The toner can be used as spherically particulate toner of the present invention. In practice, however, the former process using an organic solvent is preferred in the present invention because a high molecular weight resin can be used as a binder resin and a better particle size distribution can be easily provided.

Examples of the foregoing organic solvent to be used in the dissolution of the binder resin and the dispersion of the colorant and other additions include hydrocarbons such as pentane, hexane, heptane, benzene, toluene, xylene, cyclohexane and petroleum ether; halogenated hydrocarbons such as methylene chloride, chloroform, dichloroethane, dichloroethylene, trichloroethane, trichloroethylene and carbon tetrachloride; alcohols such as methanol, ethanol, isopropyl alcohol, n-propyl alcohol and butanol; ketones such as acetone, methyl ethyl ketone and methyl isobutyl ketone; and esters such as ethyl acetate and butyl acetate. Two or more of these organic solvents may be used in admixture.

The foregoing binder resin to be used herein is not specifically limited so far as it is soluble in the foregoing organic solvent. In practice, however, a water-insoluble resin which cannot itself be dispersed in an aqueous medium but can be dispersed in an aqueous medium only in the presence of an emulsifying agent or dispersion stabilizer or a self-water dispersible water-insoluble resin which can itself be dispersed in an aqueous medium may be used.

Examples of such a water-insoluble resin for toner include styrene resin, (meth)acrylic resin, polyester resin, polyurethane resin, and epoxy resin. Particularly preferred among these water-insoluble resins is styrene (meth)acrylic resin obtained by the polymerization of a styrene monomer and a (meth)acrylic acid ester as essential components. Examples of (meth)acryl employable herein include methacryl and acryl.

As the foregoing resin there may be preferably used one normally having a weight-average molecular weight of from 3,000 to 300,000, which level is required for the realization of a sufficient mechanical strength, and a glass transition temperature (Tg) of from 50° C. to 100° C. as determined by DSC (differential scanning calorimeter).

Among the foregoing binder resins, the self-water dispersible resin means a resin containing a functional group that can be rendered anionic upon neutralization which can form a stable water dispersion under the action of an aqueous medium free from emulsifying agent or dispersion stabilizer when the functional group that can be rendered hydrophilic is partly or entirely neutralized with a base.

Examples of the functional group which can be rendered hydrophilic upon neutralization include acidic groups such as carboxyl group, phosphoric acid group and sulfonic acid group. Examples of the resin containing such a functional group include styrene resin, (meth)acrylic resin, polyester resin, polyurethane resin, and epoxy resin. Preferred among these resins is styrene (meth)acrylate resin containing an acidic group.

As a suitable anionic styrene (meth)acrylate resin which can be rendered self-water dispersible upon neutralization there maybe used one obtained by the radical polymerization of a styrene monomer such as (meth)acrylic polymerizable vinyl monomer containing an acid group as an essential component with a polymerizable vinyl monomer other than the polymerizable vinyl monomer containing an acid group such as (meth)acrylic acid ester in the presence of a radical polymerization initiator. The polymerization reaction for this purpose can be effected properly in the form of solution polymerization, suspension polymerization or emulsion polymerization.

Examples of such an acid group-containing (meth)acrylic polymerizable monomer include acrylic acid, methacrylic acid, crotonic acid, itaconic acid, maleic acid, fumaric acid, monobutyl itaconate, and monobutyl maleate.

As the polymerizable monomer other than acid group-containing polymerizable monomer there may be used a styrenic monomer (aromatic vinyl monomer) such as styrene, vinyl toluene, 2-methylstyrene, t-butylstyrene, and chlorostyrene.

Examples of the acrylic acid ester include methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, dodecyl acrylate, 2-chloroethyl acrylate, phenyl acrylate, and methyl alfachloroacrylate.

Examples of the methacrylic acid ester include methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, dodecyl methacrylate, 2-chloroethyl methacrylate, phenyl methacrylate, and methyl alphachloromethacrylate.

Further examples of the polymerizable monomer other than acid group-containing polymerizable monomer include acrylic acid or methacrylic acid derivatives such as acrylonitrile, methacrylonitrile and acrylamide, vinyl ethers such as vinyl methyl ether, vinyl ethyl ether and vinyl isobutyl ether, vinyl ketones such as vinyl methyl ketone, vinyl hexyl ketone and methyl isopropenyl ketone, and N-vinyl compounds such as N-vinylpyrrole, N-vinylcarbazole, N-vinylindole and N-vinylpyrrolidone.

For the preparation of the resin which can be rendered self-water dispersible upon neutralization, a general-purpose organic solventmay be used if solution polymerization is effected. Specific examples of such an organic solvent include so-called inert solvents such as various aromatic hydrocarbons (e.g., toluene, xylene, benzene); various alcohols (e.g., methanol, ethanol, propanol, butanol); various ether alcohols (e.g., cellosolve, carbitol); various ketones (e.g., acetone, methyl ethyl ketone, methyl isobutyl ketone); various esters (e.g, ethyl acetate, butyl acetate) and various ether esters (e.g., butyl cellosolve acetate).

As the polymerization initiator to be used herein there may be used any known commonly used organic peroxide initiator or azo initiator. Specific examples of these initiators include peroxides such as benzoyl peroxide, cumene hydroperoxide, t-butyl hydroperoxide, sodium persulfate and ammonium persulfate, and azo compounds such as azobisobutylonitrile and azobisisovaleronitrile.

The content of carboxyl group in the carboxyl group-containing anionic resin which can be rendered hydrophilic upon neutralization is not specifically limited. If the carboxyl group-containing anionic resin is a styrene (meth) acrylate resin, it preferably has an acid value (mg of KOH required to neutralize 1 g of resin) of from 30 to 150.

The toner of the present invention may comprise any known commonly used polyester resin incorporated therein as a binder resin. As such a polyester resin there may be used one obtained by the reaction of a polyhydric alcohol with a polybasic acid or ester-forming derivative thereof.

The polyester resin which can be preferably used herein can be prepared by the dehydropolycondensation of a polybasic acid with a polyhydric alcohol as starting materials in the presence of a catalyst in the presence or absence of solvent. The polybasic acid may be partly subjected to demethanolization polycondensation with its methylesterification product thereof as one of its ester-forming derivatives.

More specifically, an aromatic polyester resin obtained by the reaction of an aromatic dicarboxylic acid such as phthalic acid or its ester-forming derivative as an essential component is preferred. The emulsification process may be effected using a binder resin soluble in the solvent used.

Examples of the polybasic acid employable herein include aromatic carboxylic acids such as terephthalic acid, isophthalic acid, phthalic anhydride, trimellitic anhydride, pyromellitic acid and naphthalenedicarboxylic acid, aliphatic carboxylic acids such as maleic anhydride, fumaric acid, succinic acid, alkenyl succinic anhydride and adipic acid, and alicyclic carboxylic acids such as cyclohexane dicarboxylic acid. These polybasic acids may be used singly or in combination.

Examples of the polyhydric alcohol employable herein include aliphatic diols such as ethylene glycol, propylene glycol, butanediol, hexanediol, neopentyl glycol and glycerin, alicyclic diols such as cyclohexanediol, cyclohexane dimethanol and hydrogenated bisphenol A, and aromatic diols such as ethylene oxide adduct of bisphenol A and propylene oxide adduct of bisphenol A. These polyhydric alcohols may be used singly or in combination.

The glass transition point of the polyester resin is preferably from 50° C. to 75° C., more preferably from 55° C. to 70° C. If the glass transition point of the polyester resin falls below 50° C., the resulting toner exhibits an insufficient heat resisting cohesiveness. On the contrary, if the glass transition point of the polyester resin exceeds 75° C., the resulting toner exhibits a deteriorated fixability to disadvantage.

The acid group content in the polyester resin can be properly adjusted by selecting the mixing proportion and percent conversion of the foregoing polybasic acid and polyhydric alcohol so that the carboxyl group by which the polyester is terminated is controlled. Alternatively, trimellitic anhydride can be used as a polybasic acid component to obtain a polyester resin comprising a carboxyl group incorporated in its main chain. In the toner of the present invention, the polyester resin preferably has an acid value of from 1 to 30.

The basic neutralizing agent used herein is not specifically limited. In practice, however, an inorganic alkali such as sodium hydroxide, potassium hydroxide, lithium hydroxide, calcium hydroxide, sodium carbonate and ammonia or an organic base such as diethylamine, triethylamine and isoproplylamine may be used.

If as a water-insoluble resin to be used as a binder resin there is used a non-self-water dispersible resin, it is necessary that the resin solution and/or aqueous medium to be mixed therewith (The term "aqueous medium" as used is meant to indicate water or a liquid medium mainly composed of water) be used in admixture with an emulsifier and/or dispersion stabilizer.

As the dispersion stabilizer there is preferably used a water-soluble polymer compound. Examples of such a water-soluble polymer compound include polyvinyl alcohol, polyvinyl pyrrolidone, hydroxyethyl cellulose, and carboxymethyl cellulose. Examples of the emulsifier employable herein include nonionic surface active agents such as polyoxyethylene alkyl phenol ether, anionic surface active agents such as sodium alkylbenzenesulfonate, and cationic surface active agents. Of course, two or more of these emulsifiers maybe used in combination. Alternatively, two or more of these dispersion stabilizers may be used in combination. Emulsifiers and dispersion stabilizers may be used in combination. In general, however, a dispersion stabilizer is mainly used in combination with an emulsifier.

The emulsifier or dispersion stabilizer, if any, is preferably used in a concentration of from about 0.5 to 3% by weight based on the weight of the aqueous medium.

Even if the foregoing resin which can be rendered self-water dispersible upon neutralization is used, an emulsifier and/or dispersion stabilizer may be used as necessary so far as it doesn't impair the effect of the present invention.

If necessary, the spherically particulate toner of the present invention may comprise a charge control agent such as metal-containing azo compound and salicylic metal complex or a wax such as polyethylene wax, polypropylene wax and paraffin wax incorporated therein in an amount of from 0.1 to 10% by weight based on the weight of the binder resin used.

The incorporation of these additives or the foregoing colorant can be accomplished by the addition of these additives to an organic solvent solution of the binder resin which is then subjected to mixing and dispersion by an ordinary mixer or disperser such as ball mill and continuous bead mill.

The dispersion of spherical colored resin particles thus obtained by emulsification is then subjected to distillation or the like so that the organic solvent is removed therefrom. The resulting aqueous dispersion is then withdrawn by filtration or other means. The particles thus obtained are then dried to obtain a particulate toner. The colored resin particles obtained with an emulsifier or dispersion stabilizer is preferably washed more thoroughly before use.

In the case where resin particles are obtained with a self-water dispersible resin obtained by neutralizing an acid group-containing water-insoluble resin with a basic neutralizing agent as a binder resin, the particles which have been freed of organic solvent is preferably subjected to neutralization of the hydrophilic group on the surface thereof which has been neutralized with the basic neutralizing agent back to the original functional group with an acidic neutralizing agent such as hydrochloric acid, sulfuric acid, phosphoric acid, acetic acid and oxalic acid so that the hydrophilicity thereof is further lowered before filtration and drying.

Drying can be accomplished by any known commonly used method. For example, the toner particles may be dried under normal or reduced pressure at a temperature such that the toner particles are not heat-fused or agglomerated. Alternatively, the toner particles may be subjected to freeze-drying.

Particularly preferred examples of drying methods which can be efficiently conducted include a method involving instantaneous drying in a heated compressed air flow using a Flush Jet Dryer (produced by Seishin Co., Ltd.) and a method involving drying with heating and stirring under reduced pressure using a Nauter mixer (produced by HOSOKAWA MICRON CORP.).

In the case where classification for removing coarse particles or fine particles is needed to unify the particle size distribution of the particulate toner, any known commonly used method using an ordinary commercially available dry classifier for toner or other purposes may be used. Alternatively, a method may be used involving classification of an aqueous slurry of spherical colored particles using the difference of sedimentation rate by particle diameter. The removal of coarse particles may be accomplished also by filtration of an aqueous slurry of spherical colored particles through a filter having a proper pore size.

A polymerization process for the preparation of a particulate toner to be used in the present invention will be described hereinafter. This process involves polymerization of polymerizable monomers having a colorant dispersed therein in a liquid medium to form spherical colored resin particles, followed by the withdrawal of the particles dispersed in the liquid medium in the form of dried powder which is then optionally subjected to classification to obtain a spherically particulate toner having a unified particle size distribution.

In some detail, a colorant and reactive monomers capable of forming a binder resin are suspended or emulsion-dispersed in a liquid medium in the presence of a dispersion stabilizer or emulsifier. The suspension or dispersion thus formed is then subjected to polymerization reaction by radical polymerization with stirring in the presence of a polymerization initiator to obtain an aqueous dispersion of spherical toner particles having a colorant encapsulated in a binder resin.

Specific examples of the radical-polymerizable monomer employable herein include acryl monomers such as styrene (e.g., styrene, α-methylstyrene, chlorostyrene, vinylstyrene), monoolefin (e.g., ethylene, propylene, butylene, isobutylene), vinyl ester (e.g., vinyl acetate, vinyl propionate, vinyl butyrate, vinyl benzoate), α-methylenealiphatic monocarboxylic acid ester (e.g., methyl acrylate, ethyl acrylate, butyl acrylate, octyl acrylate, dodecyl acrylate, phenyl acrylate, methyl methacrylate, ethyl methacrylate, butyl methacrylate, dodecyl methacrylate), glycolmono(meth)acrylic acid ester (e.g., ethyleneglycol monoacrylate, propyleneglycol monoacrylate, tetramethylene ether glycol monoacrylate), vinyl ether (e.g., vinyl methyl ether, vinyl ethyl ether, vinyl butyl ether), and vinyl ketone (e.g., vinyl methyl ketone, vinyl hexyl ketone, vinyl propenyl ketone) These radical-polymerizable monomers may be used singly or in combination.

The monomer composition constituting the binder resin is prepared such that the resulting polymer exhibits a glass transition temperature (Tg) of from 50° C. to 80° C.

If necessary, these monomers may be used in combination with a small amount of a reactive monomer having two or more ethylenically unsaturated double bonds. Examples of such a reactive monomer having two or more ethylenically unsaturated double bonds include conjugated diene such as butadiene and isoprene, divinyl benzene, di(meth)acrylate of bisphenol A-alkylene oxide adduct, trimethylolpropane tri (meth)acrylate, and pentaerythritol tetra(meth)acrylate.

As the polymerization initiator for use in the preparation of such a resin there may be, of course, used any ordinary oil-soluble or water-soluble polymerization initiator. Examples of such an oil-soluble or water-soluble polymerization initiator include various oxides such as benzoyl peroxide, di-t-butyl peroxide, cumene hydroperoxide, t-butyl peroxide and 2-ethyl hexanoate, and various azo compounds such as azobisisobutylonitrile and azobisisovaleronitrile.

For suspension polymerization, a polymerization initiator insoluble in the liquid medium used but soluble in the monomer used may be selected as an essential initiator. For emulsion polymerization, a water-soluble polymerization initiator may be selected as an essential initiator. The amount of the polymerization initiator to be used is not specifically limited. In practice, however, it may be from 0.01 to 5 parts by weight based on 100 parts by weight of all the reactive monomers used.

The binder resin formed by polymerization may be arbitrarily adjusted by polymerization conditions or the like. Preferably, the binder resin is adjusted to have a weight-average molecular weight of from 10,000 to 500,000.

As the colorant, charge control agent and wax to be incorporated in the particulate toner there may be used any known commonly used materials similarly to the foregoing emulsion process toner.

As the dispersion stabilizer to be used in suspension polymerization there may be normally used a water-soluble polymer compound. Examples of such a water-soluble polymer compound include polyvinyl alcohol, polyvinyl pyrrolidone, hydroxyethyl cellulose, carboxylmethyl cellulose, cellulose gum, and so on.

Further, an inorganic water-insoluble particulate material having a particle diameter of from 0.01 to 5 μm, too, may be used as a suspension dispersion stabilizer. Examples of such a material include tricalcium phosphate, talc, bentonite, kaolin, titanium oxide, alumina, zinc white, aluminum hydroxide, magnesium hydroxide, basic magnesium silicate, titanium hydroxide, ferric hydroxide, barium sulfate, silica, magnesium carbonate, and calcium carbonate.

These dispersion stabilizers may be used singly or in combination. The amount of such a dispersion stabilizer to be used is normally from 0.1 to 10 parts by weight based on 100 parts by weight of all the reactive monomers.

Examples of the emulsifying agent to be used in emulsion polymerization include anionic surface active agents such as sodium dodecylbenzenesulfonate, sodium laurylsulfate and sodium dodecyldiphenyloxidedisulfonate, and nonionic surface active agents such as polyoxyethylene lauryl ether and polyoxyethylene nonyl phenol ether. These emulsifying agents may be used singly or in combination. The amount of the emulsifying agent to be used is normally from 0.01 to 5 parts by weight based on 100 parts by weight of all the reactive monomers.

For suspension polymerization, the dispersion stabilizer may be used in combination with a small amount of an emulsifying agent. Alternatively, for emulsion polymerization, the emulsifying agent may be used in combination with a small amount of a dispersion stabilizer. The foregoing dispersion stabilizer or emulsifying agent may be replaced by a self-emulsifiable epoxy resin or self-emulsifiable polyurethane resin.

The foregoing polymerizable monomer, colorant, dispersion stabilizer, liquid medium and polymerization initiator may be simultaneously added and stirred to polymerize monomer droplets. Alternatively, the polymerizable monomer and colorant may be thoroughly mixed by ball mill or colloid mill, and then added to a liquid medium containing a polymerization initiator and a dispersion stabilizer. The mixture is then stirred by a homogenizer, rotor stator type mixer, static mixer or the like so that droplets of the monomer comprising polymerizable monomers as essential component is suspended in a liquid medium. The mixture is further stirred to undergo polymerization until a particulate toner having a predetermined particle diameter is formed.

Examples of the liquid medium to be used in polymerization include water such as distilled water and ion-exchanged water, various aromatic hydrocarbons such as toluene, xylene and benzene, various alcohols such as methanol, ethanol, propanol and butanol, various ether alcohols such as cellosolve and carbitol, various ketones such as acetone, methyl ethyl ketone and methyl isobutyl ketone, various esters such as ethyl acetate and butyl acetate, and various ether esters such as butyl cellosolve acetate.

In any of the foregoing polymerization processes, core-shell polymerization, power feed polymerization or graft polymerization may be employed to vary the chemical structure or layer structure of the particles. By properly controlling the reaction conditions in the foregoing suspension polymerization and emulsion polymerization processes, a spherically particulate colored resin can be easily obtained in powder form. In order to remove the dispersion stabilizer or emulsifying agent from the dispersion, it is preferred that the dispersion be repeatedly washed. An operation such as drying and classification may be effected in the same manner as in the emulsification process for the preparation of particulate toner.

In order to unify the particle size distribution of toner particles, classification may be effected in the same manner as for emulsification process toner as necessary.

The use of the toner thus obtained not only makes it easy to predetermine the amount of the toner to be attached to the developer-supporting roll to a range of from not less than 0.1 $mg/cm^2$ to not more than 0.45 $mg/cm^2$ but also makes it possible to obtain an image quality having excellent resolution, tone reproduction and little fog.

The present invention provides the following novel developmment processes:

1. A non-magnetic one-component developmment process which comprises supplying a developer onto a photoreceptor using a non-magnetic one-component developing machine comprising at least a developer-supporting roll and a layer-forming blade so that an electrostatic latent image on said photoreceptor is developed, wherein said developer is a spherically particulate toner having a volume-average particle diameter of from 1 to 6 $\mu$m and the amount of said toner to be attached to said developer-supporting roll is from 0.1 $mg/cm^2$ to 0.45 $mg/cm^2$.

2. The non-magnetic one-component developmment process according to Clause 1, wherein said developer is a spherically particulate toner comprising a styrene (meth) acrylate resin as a binder resin and carbon black as a colorant, the content of said carbon black being not less than 8% by weight.

3. The non-magnetic one-component developmment process according to Clause 1, wherein said developer is a spherically particulate toner comprising a polyester resin as a binder resin and an organic pigment as a colorant, the content of said organic pigment being not less than 3% by weight.

4. The non-magnetic one-component developmment process according to any one of Clauses 1 to 3, wherein said developer is a spherically particulate toner having an average circularity of not less than 0.97 comprising a colorant encapsulated in a binder resin.

5. The non-magnetic one-component developmment process according to Clause 4, wherein said spherically particulate toner as developer comprises inorganic oxide fine particles externally added thereto in an amount represented by the following relationship:

$$3.5714X^{-0.9942} \leqq Y \leqq 31.399X^{-0.9477}$$

wherein X represents a volume-average particle diameter ($\mu$m) of toner particles; and Y represents an added amount (wt-%) of inorganic oxide fine particles based on the weight of toner particles.

6. The non-magnetic one-component developmment process according to Clause 5, wherein said spherically particulate toner as developer has a particle size distribution such that the ratio of 50%-volume particle diameter/50%-number particle diameter is not more than 1.25 and the square root of the ratio of 84%-volume particle diameter/16%-volume particle diameter is not more than 1.25.

7. The non-magnetic one-component developmment process according to Clause 4, wherein said particulate toner is obtained by a process which comprises mixing an organic solvent solution comprising a colorant and a water-insoluble binder resin as essential components and an aqueous medium, emulsifying the mixture to form spherical colored particles, and then withdrawing the said particles dispersed in the liquid medium in the form of dried powder.

8. The non-magnetic one-component developmment process according to Clause 4, wherein said particulate toner is obtained by a process which comprises allowing polymerizable monomers having a colorant dispersed therein to undergo polymerization in a liquid medium to form spherical colored particles, and then withdrawing the said particles dispersed in the liquid medium in the form of dried powder.

EXAMPLE

The present invention will be further described in the following resin synthesis examples, examples and comparative examples. The "parts" and "%" as used hereinafter are all by weight.

Resin Synthesis Example 1

(Synthesis Example of Carboxyl Group-containing Styrene-acrylic Resin)

667 parts of methyl ethyl ketone were charged into a 3 L flask equipped with a dropping apparatus, a thermometer, a nitrogen gas intake pipe, an agitator and a reflux condenser. The reaction material was heated to a temperature of 80° C. To the reaction material was then added dropwise a mixture having the following monomers and polymerization initiator in about 2 hours. This reaction was effected in a flow of nitrogen.

| | |
|---|---|
| Styrene | 668 parts |
| Butyl acrylate | 223 parts |
| Acrylic acid | 109 parts |
| "Perbutyl O" | 50 parts |

After the termination of the dropwise addition, 3 parts of "Perbutyl O" (radical polymerization initiator produced by NOF Corp.) were added to the mixture every 3 hours three times in all. The reaction further continued for 4 hours. Thereafter, the reaction mixture was freed of solvent to obtain a solid resin (R-1) The resin thus obtained exhibited a glass transition temperature of 72° C., a weight-average molecular weight of 20,000 and an acid value of 81.

Resin Synthesis Example 2

(Synthesis Example of Carboxyl Group-containing Styrene-acrylic Resin)

A 114/12/24 mixture (by parts) of methyl ethyl ketone, isopropyl alcohol and water was charged into a 3 L flask equipped with a dropping apparatus, a thermometer, a nitrogen gas intake pipe, an agitator and a reflux condenser. The reaction mixture was heated to a temperature of 80° C. Into the flask was then charged a mixture having the following monomers and polymerization initiator of Composition 1 at once. The reaction then began.

Composition 1

| | |
|---|---|
| Styrene | 330 parts |
| Butyl acrylate | 216 parts |
| Acrylic acid | 54 parts |
| "Perbutyl O" | 0.6 part |

Subsequently, after 3 hours, the reaction resin solution was sampled in an amount of about 10 parts, diluted with the same amount of methyl ethyl ketone, and then measured for viscosity by means of a Gardner viscometer. When the viscosity of the sample reached P-Q, to the reaction mixture was then added a 567/63 mixture of methyl ethyl ketone and isopropyl alcohol. When the temperature of the reaction mixture reached 80° C., to the reaction mixture was then added dropwise the mixture of Composition 2 in 1 hour. The percent monomer residue was determined by gas chromatography. In this manner, the percent polymerization at the first stage was calculated. The results were 60%.

Composition 2

| | |
|---|---|
| Styrene | 413 parts |
| Butyl acrylate | 133 parts |
| Acrylic acid | 54 parts |
| "Perbutyl O" | 18 parts |

After the termination of the dropwise addition, 2 parts of "Perbutyl O" were added to the mixture every 3 hours three times in all. The reaction further continued for 4 hours. Thereafter, the reaction mixture was freed of solvent to obtain a solid resin (R-2). The resin thus obtained exhibited a glass transition temperature of 61° C., a weight-average molecular weight of 124,000 and an acid value of 70.

Toner Preparation Example 1

2,000 parts of R-2 and 500 parts of carbon black (ELFTEX 8, produced by Cabot Corp.) were kneaded by means of a kneader for 1 hour to give a master batch.

750 parts of the master batch thus obtained, 450 parts of the solid resin R-2 and 300 parts of the solid resin R-1 were dissolved in 1,000 parts of methyl ethyl ketone. Subsequently, to the carbon-dispersed resin solution thus obtained were added 150 parts of a Type H808 wax dispersion (produced by Chukyo Yushi Co., Ltd.; wax particle diameter: 0.5 $\mu$m; wax content: 30%). The mixture was then subjected to mixing and dispersion using a Type M-250 Eiger motor mill for 10 minutes. To the dispersion thus obtained was then added methyl ethyl ketone to adjust the nonvolatile content to 53%. Thus, a mill base was prepared.

Subsequently, to 566 parts of the mill base thus prepared were added 48 parts of a 1 N aqueous solution of sodium hydroxide, 58 parts of isopropyl alcohol and 150 parts of deionized water. The mixture was then thoroughly stirred. The reaction mixture was kept at an inner temperature of 30° C. where 43 parts of deionized water were then added thereto with stirring to cause phase inversion emulsification by which resin particles were formed. After 30 minutes, to the resin particles were then added 500 parts of deionized water.

Subsequently, the reaction solution was subjected to distillation under reduced pressure to remove the organic solvent therefrom. The resin particles were then separated from the aqueous medium by filtration. The resin particles thus separated were then dispersed again in water. Subsequently, the dispersion thus obtained was adjusted to a pH value of 2.5 with a 1 N aqueous solution of hydrochloric acid. The dispersion was then stirred for 30 minutes. The aqueous slurry was then treated by a centrifugal separator to remove the fine powder component therefrom. Subsequently, the aqueous slurry was passed through a filter (Chisso Filter Co., Ltd.) to remove coarse particles therefrom. Thereafter, the aqueous slurry was re-dispersed and washed. The resulting resin particles were separated from the aqueous medium to obtain a wet cake which was then freeze-dried to prepare a particulate black resin in powder form.

The black resin particles thus obtained had the volume-average particle diameter of 5.0 $\mu$m as determined by Coulter Multisizer and exhibited a good particle size distribution such that the ratio of 50%-volume particle diameter/50%-number particle diameter was 1.10 and the square root of the ratio of 84%-volume particle diameter/16%-volume particle diameter was 1.21. The black resin particles thus obtained also exhibited an average circularity of 0.989 as determined by a Type FPIP-1000 flow particle image analyzer produced by Toa Iyo Denshi Co., Ltd. The particle was embedded in a resin, cut by a microtome, and then observed at the section by TEM (transmission type electron microscope). As a result, carbon black was found encapsulated and uniformly dispersed in the particle.

To 100 parts of the powder were then added 1.3 parts of a Type MT-150 titanium oxide produced by TAYCA CORP. and 1.9 parts of a Type Wacker HDK SLM50650 hydrophobic silica by means of a Henschel mixer to prepare a spherically particulate toner 1.

Toner Preparation Example 2

The procedure of Example 1 was followed except that 54 parts of a 1 N aqueous solution of sodium hydroxide, 52 parts of isopropyl alcohol and 130 parts of deionized water were added to 566 parts of the mill base which was thoroughly stirred, and then kept at an inner temperature of 30° C. where it was then subjected to phase inversion emulsification with stirring while 21 parts of deionized water was being added dropwise thereto. Thus, a desired particulate black resin was obtained.

The resin particles thus obtained had the volume-average particle diameter of 3.2 $\mu$m and exhibited a good particle size distribution such that the ratio of 50%-volume particle diameter/50%-number particle diameter was 1.11 and the square root of the ratio of 84%-volume particle diameter/16%-volume particle diameter was 1.20. The resin particles thus obtained also exhibited an average circularity of 0.990. The particle was then observed at a section thereof by TEM. As a result, carbon black was found encapsulated and uniformly dispersed in the particle.

To 100 parts of the powder were then added 1.5 parts of a Type MT-150 titanium oxide and 2.5 parts of a Type SLM50650 hydrophobic silica to prepare a spherically particulate toner 2.

Toner Preparation Example 3

To 1,200 parts of a polyester resin having an acid value of 4 mg·KOH/g, a weight-average molecular weight of 12,000, a glass transition point of 61° C. and a melt viscosity of 40,000 poise at 100° C. were added 800 parts of methyl ethyl ketone. The mixture was then thoroughly subjected to dissolution. To the resulting resin solution were then added 76.5 parts of a Type Ket Blue 123 phthalocyanine pigment (produced by DAINIPPON INK & CHEMICALS, INC.). The mixture was then stirred until it was thoroughly dispersed. After the termination of dispersion, the mixture was adjusted with methyl ethyl ketone to a solid content of 50%.

Subsequently, to 200 parts of the mixture were added 50 parts of methyl ethyl ketone and 3.5 parts of a 1 N aqueous ammonia. To the mixture were then added 225 parts of water with stirring at once to cause phase inversion emulsification. As a result, blue resin particles were formed. To the liquid dispersion in which the particles were dispersed were then added 150 parts of water as a diluting water and 4 parts of a 1 N aqueous ammonia for increasing dispersion stability.

Subsequently, the liquid dispersion in which the particles were dispersed were subjected to distillation under reduced pressure to remove the organic solvent therefrom. Thus, an aqueous dispersion was obtained. To the aqueous dispersion was then added a 1 N aqueous solution of hydrochloric acid to adjust the pH value thereof to 2.5. The aqueous slurry was then treated by a centrifugal separator to remove fine powder components therefrom. The aqueous slurry was then passed through a filter to remove coarse particles therefrom. The aqueous slurry was filtrated and washed with water to obtain a wet cake. The wet cake thus obtained was heated and dried with stirring under reduced pressure to obtain blue resin particles (pigment content: 6%) in powder form.

The blue resin particles thus obtained had the volume-average particle diameter of 4.8 μm and exhibited a good particle size distribution such that the ratio of 50%-volume particle diameter/50%-number particle diameter thereof was 1.11 and the square root of the ratio of 84%-volume particle diameter/16%-volume particle diameter thereof was 1.19. The blue resin particles had an average circularity of 0.988. As a result of observation by TEM, the phthalocyanine pigment was found encapsulated and uniformly dispersed in the particle.

To 100 parts of the powder were then added 0.5 part of a Type MT-150 titanium oxide and 2.8 parts of a Type RY200 hydrophobic silica (produced by Nippon Aerosil Co., Ltd.) to prepare a spherically particulate toner 3.

Toner Preparation Example 4

Particle formation was effected in the same manner as in Toner Preparation Example 1 except that the carbon black content in the binder resin was 6%. Thus, spherical black resin particles having the volume-average particle diameter of 5.0 μm and a good particle size distribution such that the ratio of 50%-volume particle diameter/50%-number particle diameter thereof was 1.09 and the square root of the ratio of 84%-volume particle diameter/16%-volume particle diameter thereof was 1.18 were obtained. The particles had an average circularity of 0.989. As a result of observation by TEM, carbon black was found encapsulated and uniformly dispersed in the particle. To the powder were then externally added the same additives as used in Example 1 in the same manner as in Example 1 to prepare a spherically particulate toner 4.

Toner Preparation Example 5

The procedure of Example 1 was followed except that 52 parts of a 1 N aqueous solution of sodium hydroxide, 75 parts of isopropyl alcohol and 130 parts of deionized water were added to 566 parts of the mill base prepared in Toner Preparation Example 1 which was thoroughly stirred, and then kept at an inner temperature of 30° C. where it was then subjected to phase inversion emulsification with stirring while 50 parts of deionized water was being added dropwise thereto. Thus, a desired particulate black resin was obtained.

The resin particles thus obtained had the volume-average particle diameter of 7.8 μm and exhibited a good particle size distribution such that the ratio of 50%-volume particle diameter/50%-number particle diameter was 1.10 and the square root of the ratio of 84%-volume particle diameter/16%-volume particle diameter was 1.20. The resin particles thus obtained also exhibited an average circularity of 0.989. The particle was then observed at a section thereof by TEM. As a result, carbon black was found encapsulated and uniformly dispersed in the particle.

To 100 parts of the powder were then added 0.5 part of a Type MT-150 titanium oxide and 1.0 part of Type SLM50650 hydrophobic silica to prepare a spherically particulate toner 5.

Toner Preparation Example 6

The mill base prepared in Toner Preparation Example 1 was thoroughly desolvated under reduced pressure, crushed, and then classified by means of a dry classifier to obtain a particulate black resin having a volume-average particle diameter of 7.3 μm, a particle size distribution such that the ratio of 50%-volume particle diameter/50%-number particle diameter is 1.24 and the square root of the ratio of 84%-volume particle diameter/16%-volume particle diameter is 1.27 and an average circularity of 0.947. To 100 parts of the black resin particles were then added 0.5 part of a Type MT-150 finely particulate titanium oxide and 1.2 parts of a Type SLM50650 hydrophobic silica to prepare an amorphous toner 6.

Toner Preparation Example 7

940 parts of the same polyester resin as used in Toner Preparation Example 3 and 60 parts of a phthalocyanine pigment "Ket Blue 1231" were melt-kneaded, crushed, and then classified by means of a dry classifier to obtain a particulate blue resin (pigment content: 6%) having a volume-average particle diameter of 5.3 μm, a particle size distribution such that the ratio of 50%-volume particle diameter/50%-number particle diameter is 1.34 and the square root of the ratio of 84%-volume particle diameter/16%-volume particle diameter is 1.32 and an average circularity of 0.941. To 100 parts of the blue resin particles were then added 0.5 part of a Type MT-150 finely particulate titanium oxide and 2.7 parts of a Type RY200 hydrophobic silica to prepare an amorphous toner 7.

Examples and Comparative Examples of Development Test

The seven kinds of toners thus prepared were subjected to non-magnetic one-component developmment test in the following manner. In some detail, the toner cartridge of a commercially available one-component printer (OKI Microline 400) was loaded with each of these toners. Using this toner cartridge, a test pattern was printed. The image thus printed was then evaluated for fog, resolution, tone reproduction and image density. For the polyester resin toners, imaging by the foregoing printer was followed by fixing by a silicone oil-coated type fixing unit.

For the measurement of the amount of the toner to be attached to the developer-supporting roll, the toner was peeled off the developer-supporting roll with an adhesive tape at a predetermined area. The adhesive tape was then measured for weight.

The amount of the toner consumed until 1,000 sheets of the test pattern image was printed was measured. For the measurement of image density, a Macbeth densitometer was used. For the measurement of fog, visual observation was effected. The results are set forth in Table 1.

TABLE 1

| Example No. | Toner used | Attached amount of toner | Consumed amount of toner | Fog | Resolution | Tone reproduction | Image density |
|---|---|---|---|---|---|---|---|
| Example 1 | Toner 1 | 0.33 | 10.1 | None | + | + | 1.60 |
| Example 2 | Toner 2 | 0.20 | 7.2 | None | ++ | ++ | 1.58 |
| Example 3 | Toner 3 | 0.38 | 11.3 | None | + | + | 1.50 |
| Example 4 | Toner 4 | 0.34 | 10.2 | None | + | + | 1.22 |
| Comparative Example 1 | Toner 5 | 0.58 | 18.0 | None | Standard | Standard | 1.56 |
| Comparative Example 2 | Toner 6 | 0.65 | 23.0 | None | Standard | Standard | 1.55 |
| Comparative Example 3 | Toner 7 | 0.48 | 17.6 | Observed | + | + | 1.48 |

Attached amount of toner: $mg/cm^2$
Consumed amount of toner: Amount (g) per 1,000 sheets of printing
Resolution, tone reproduction:
+ Better than standard;
++ Even better than standard As can be seen in Table 1, the use of the non-magnetic one-component developmment process of the present invention makes it possible to not only drastically improve the image quality but also drastically reduce the amount of the toner to be consumed per sheet of printing paper. The toner of Example 4 leaves something to be desired in image density but can be put into practical use. The present developmment process employs a spherically particulate toner having a small particle diameter. By properly predetermining the particle size distribution, composition, preparation process and other conditions of the toner, the toner can be provided with even better properties.

What is claimed is:

1. A non-magnetic one-component developmment process which comprises supplying a developer onto a photoreceptor using a non-magnetic one-component developing machine comprising at least a developer-supporting roll and a layer-forming blade so that an electrostatic latent image on said photoreceptor is developed, wherein said developer is a spherically particulate toner having a volume-average particle diameter of from 1 to 6 $\mu$m and the amount of said toner to be attached to said developer-supporting roll is from 0.1 $mg/cm^2$ to 0.45 $mg/cm^2$.

2. The non-magnetic one-component developmment process according to claim 1, wherein said developer is a spherically particulate toner comprising a styrene (meth) acrylate resin as a binder resin and carbon black as a colorant, the content of said carbon black being not less than 8% by weight.

3. The non-magnetic one-component developmment process according to claim 1, wherein said developer is a spherically particulate toner comprising a polyester resin as a binder resin and an organic pigment as a colorant, the content of said organic pigment being not less than 3% by weight.

4. The non-magnetic one-component development process according to any one of claims 1 to 3, wherein said developer is a spherically particulate toner having an average circularity (average of circularity defined by (perimeter of circle having the same area as the projected area of particle)/(perimeter of the projected image of particle)) of not less than 0.97 comprising a colorant encapsulated in a binder resin.

5. The non-magnetic one-component development process according to claim 4, wherein said spherically particulate toner as developer comprises inorganic oxide fine particles externally added thereto in an amount represented by the following relationship:

$$3.5714X^{-0.9942} \leqq Y \leqq 31.399X^{-0.9477}$$

wherein X represents a volume-average particle diameter ($\mu$m) of toner particles; and Y represents an added amount (wt-%) of inorganic oxide fine particles based on the weight of toner particles.

6. The non-magnetic one-component development process according to claim 5, wherein said spherically particulate toner as developer has a particle size distribution such that the ratio of 50%-volume particle diameter/50%-number particle diameter is not more than 1.25 and the square root of the ratio of 84%-volume particle diameter/16%-volume particle diameter is not more than 1.25.

7. The non-magnetic one-component development process according to claim 4, wherein said particulate toner is obtained by a process which comprises mixing an organic solvent solution comprising a colorant and a water-insoluble binder resin as essential components and an aqueous medium, emulsifying the mixture to form spherical colored particles, and then withdrawing the said particles dispersed in the liquid medium in the form of dried powder.

8. The non-magnetic one-component development process according to claim 4, wherein said particulate toner is obtained by a process which comprises allowing polymerizable monomers having a colorant dispersed therein to undergo polymerization in a liquid medium to form spherical colored particles, and then withdrawing the said particles dispersed in the liquid medium in the form of dried powder.

* * * * *